US006726614B1

(12) United States Patent
Klas

(10) Patent No.: US 6,726,614 B1
(45) Date of Patent: Apr. 27, 2004

(54) METHOD AND DEVICE FOR SHORTENING THE FLAP OF PAPER RESULTING AFTER AN UNSUPPORTED ROLL CHANGE

(75) Inventor: Ernst Klas, Siegburg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 161 days.

(21) Appl. No.: 10/019,001

(22) PCT Filed: Jul. 4, 2000

(86) PCT No.: PCT/EP00/06207

§ 371 (c)(1),
(2), (4) Date: Dec. 19, 2001

(87) PCT Pub. No.: WO01/04034

PCT Pub. Date: Jan. 18, 2001

(30) Foreign Application Priority Data

Jul. 8, 1999 (DE) ..... 199 31 797

(51) Int. Cl.[7] ..... B31B 1/14; B65H 19/20

(52) U.S. Cl. ..... 493/342; 493/373; 242/553; 242/556; 242/554.2

(58) Field of Search ..... 493/340, 342, 493/343, 344, 345, 346, 369, 373, 379, 380, 381; 242/551, 553, 554.2, 554.4, 554.6, 555, 555.3, 556

(56) References Cited

U.S. PATENT DOCUMENTS

| | | | | | |
|---|---|---|---|---|---|
| 2,013,623 | A | * | 9/1935 | Bernard | 242/554.2 |
| 2,775,409 | A | * | 12/1956 | Pomper | 242/555.3 |
| 4,173,314 | A | * | 11/1979 | Curran et al. | 242/554.4 |
| 4,245,795 | A | * | 1/1981 | Ludszeweit et al. | 242/553 |
| 4,415,127 | A | * | 11/1983 | Seragnoli | 242/553 |
| 4,579,293 | A | * | 4/1986 | Steiniger | 242/555 |
| 4,652,329 | A | * | 3/1987 | Focke | 242/554.2 |
| 4,729,519 | A | * | 3/1988 | Tafel et al. | 242/554.4 |
| 5,318,646 | A | * | 6/1994 | Cardini et al. | 242/555 |
| 5,354,006 | A | * | 10/1994 | Roder | 242/554.2 |
| 5,356,496 | A | | 10/1994 | Lincoln et al. | |
| 5,709,355 | A | * | 1/1998 | Kinnunen et al. | 242/555.3 |
| 5,779,184 | A | * | 7/1998 | Kaufmann et al. | 242/554.2 |
| 5,827,166 | A | | 10/1998 | Cestonaro | |
| 6,547,179 | B1 | * | 4/2003 | Klas | 242/554.2 |

FOREIGN PATENT DOCUMENTS

| | | | |
|---|---|---|---|
| DE | 20 23 100 | | 12/1971 |
| DE | 29 19 236 | | 11/1977 |
| DE | 29 11 268 | | 10/1980 |
| DE | 30 06 319 | | 2/1986 |
| DE | 198 04 415 | | 8/1999 |
| WO | WO 99/40004 | * | 8/1999 |

* cited by examiner

*Primary Examiner*—John Sipos
*Assistant Examiner*—Louis Huynh
(74) *Attorney, Agent, or Firm*—Herbert Dubno

(57) ABSTRACT

A method and device for trimming flaps formed upon joining a leading end of a new roll to the trading end of a web of a preceding roll in which the web, after joining, is guided around an upstream roller, along a straight path and then onto a downstream roller. A nozzle directs an air stream in the direction of movement of the web or along the width thereof to cause the flap to erect. Downstream of the nozzle a blade trims the flap while it is erected by the air stream.

15 Claims, 1 Drawing Sheet

METHOD AND DEVICE FOR SHORTENING THE FLAP OF PAPER RESULTING AFTER AN UNSUPPORTED ROLL CHANGE

CROSS REFERENCE TO RELATED APPLICATIONS

This application is a national stage of PCT/EP00/06207 filed 4 Jul. 2000 and is based upon German national application 199 31797.6 filed 8 Jul. 1989 under the International Convention.

FIELD OF THE INVENTION

The invention relates to a method for shortening the flap of a paper roll for on-the-fly roll replacement and to an apparatus for carrying out this method.

BACKGROUND OF THE INVENTION

Continuously operating paper processing machines, especially roll-rotating machines, have paper webs which are wound off of rolls. When one roll reaches its end, it is replaced by a new roll without bringing the processing machine to standstill. Roll changers are known which operate by a so-called unsupported roll change or roll change on-the-fly principle. Thus at the beginning of a roll change a new roll in a standby position is initially provided with a glued tip. The new roll is then set into rotation and brought to a peripheral speed which is synchronized with the speed of the web running from the practically empty roll. The web is pressed at the correct point in time against the new roll so that it contacts the new roll in the region of the glued tip. Thus the beginning of the new web is glued onto the traveling web. The traveling web is cut shortly behind the glue location.

In accordance with DE 26 19 236 C3, in which a roll changer with an associated control is described, the so-called "glue flap" segment of the old web has a predetermined length from the glue location to the separated end to enable the glue flap to travel through the printing machine without detriment.

It has been found, however, that this flap in subsequent processing stations can be the source of detriment when it has its usual length. Since the cut always is delayed partially by the inertial mass of the separating device and as a function of the cycling time of the controller, the flap cannot be made optionally short at the outset. If there is, for example, a delay of say 10 ms and the web speed is 15 m/s, the flap is at least 150 mm long.

According to DE 29 11 268 A1, which describes a similar roll changer, utilizing a nonstop deflection of the material web, the flap is held as short as possible since it can be detrimental for further processing. This is achieved according to the mentioned publication in that on the new roll behind the glueable region a tear strand serving as a separating element is stretched which extends at an inclination above the material web and is provided with an entrainer. This remains adherent upon the pressing of the paper web against the new roll to the pressing roll and activates the tear strand so that it will separate the paper web. It is thus possible to glue the runoff paper web without a flap onto the new paper web.

It has been found in practice, however, that the cost of roll preparation and the control of the tear strand after gluing are comparatively expensive. As a result this process has not been widely used in practice.

In the method which has become known from DE 20 23 100 B2 and the associated apparatus, the new web is initially fed parallel to the running-off web with a slight distance therefrom in a connecting stretch and is accelerated to its velocity. Then one of the two webs is pressed onto an adhesive strip glued on both sides and then pressed with the adhesive strip against the other web. The trailing end of the runoff web is cut off with a blade disposed at the start of the connecting stretch. The segment of the runoff web which is located between the adhesive location and the cutting location is the flap. At the end of the connecting stretch, a second blade is arranged at a short spacing from the surface of a deflecting roller and has its cutting edge oriented counter to the travel direction of the paper web. This blade serves to separate the leading end of the new web. This blade is not suitable for shortening the flap since the latter is disposed on the inner side of the arc as the webs pass around the deflecting roller so that this flap is clamped between the web and the surface of the deflecting roller.

OBJECTS OF THE INVENTION

It is an object of the invention to provide a method whereby the flap can be foreshortened to an undetrimental degree before it travels into a subsequent processing station.

It is also an object to provide an apparatus which is appropriate for carrying out the new method.

SUMMARY OF THE INVENTION

These objects are attained in a method for shortening a flap hanging from a paper web in conjunction with a roll replacement on the fly in which a continuous paper web is withdrawn from a roll coming to an end is withdrawn and fed to a processing station and the beginning of a new roll provided with glue and synchronized with the continuous paper web is pressed thereagainst and then after a brief time interval the original web is lopped. According to the invention, the paper web glued together and from which the flap still hangs is guided along a straight segment of its path, on the side on which the web is found, an air stream traveling in the same direction as the web travel is generated which spreads over the paper web at least over a part of the straight path segment while the flap travels this part, and the flap erected by the air stream is cut off at the latest when it reaches the end of the straight path segment.

An apparatus for shortening the flap hanging from a glued-together paper web in conjunction with a roll replacement on the fly can include an unwinding unit equipped with a device for roll replacement on the fly, in which a continuous paper web which is withdrawn from a roll reaching its end and fed to a processor is pressed against the beginning of a new roll synchronized with the continuous paper web and provided with glue. Then after a brief interval the original web is lopped. Two deflecting rolls can be provided between which the paper web travels in a straight path segment and a cutting tool can be provided in the region of the straight path segment at a short distance from the paper web and with a cutting edge oriented opposite the web travel direction.

A blowing nozzle can be disposed approximately at the start of the straight path segment adjacent the paper web.

The blowing nozzle as seen in the web travel direction, can be disposed upstream of the inlet side deflecting roller.

A baffle plate can be disposed approximately parallel to the paper web along the straight path segment.

A suction box with a collecting sieve can be arranged adjacent the cutting tool. The collecting sleeve can be an endlessly traveling collection sieve.

A blower can be provided with a suction side connected with the suction box and a pressure side connected with the blowing nozzle.

A blower element can be provided for the passing paper web neighboring the cutting tool.

A support element for the web can be swingable selectively into a standby position or into an active position.

BRIEF DESCRIPTION OF THE DRAWING

The drawing serves for explaining the invention.

SPECIFIC DESCRIPTION

Figure 1:
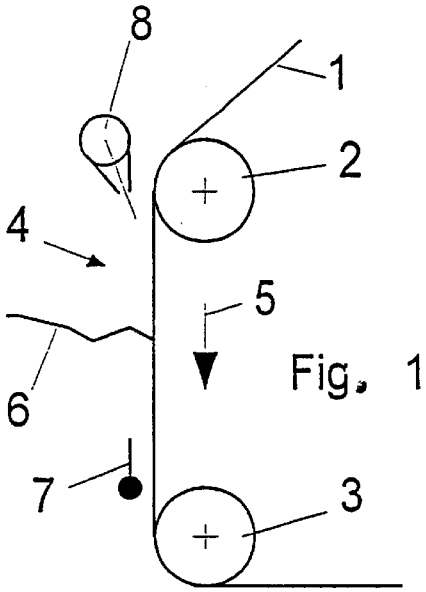
FIG. 1 is a diagram of a first embodiment of a flap-shortening apparatus according to the invention.

The simplified embodiment illustrated schematically in FIG. 1 has a paper web 1 traveling between an inlet side deflecting roller 2 and an outlet side deflecting roller 3 in a straight stretch segment 4 in the direction of the arrow 5. Shortly before the contact line of the web on the deflecting roller 3 on the side on which an about 15 to 50 cm long flap 6 hangs, there is a blade 7 whose serrated cutting edge is turned opposite the travel direction. Adjacent the deflecting roller 2, at the start of the straight stretch 4, there is a blasting nozzle 8 which extends over the width of the paper web 1 and directs its blast at an acute angle to the paper web.

As soon as the flap 6 approaches the deflecting roller 2 from above, the blast nozzle 8 is supplied with compressed air. As a result, on the side on which the flap 6 is located, an air stream directed in the same direction as the web travel is produced which flows over the paper web substantially over the entire length of the straight segment 4. The flow velocity is greater, preferably significantly greater than the web speed. As soon as the flap 6 passes the blast nozzle 8, the flap is separated from the paper web by the subatmospheric pressure generated by the air stream and is erected. The erecting effect is supported by the centrifugal force which is effective in the rerouting region of the deflecting roller 2. In the air stream which sweeps the paper web 1, the flap 6 maintains its orientation at substantially a right angle to the paper web until it reaches the blade 7. There it is cut off except for a remainder of several millimeters which corresponds substantially to the spacing of the blade 7 from the paper web. The process is repeated with each roll replacement, i.e. in time intervals of about 15 to 60 minutes.

Figure 2:
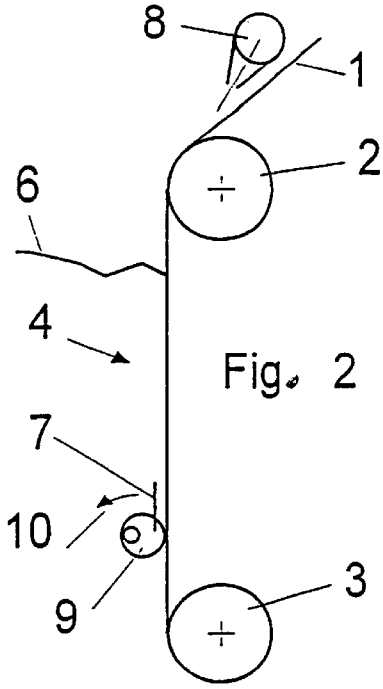
FIG. 2 is a diagram of a second embodiment of a flap-shortening apparatus according to the invention.

According to FIG. 2 the blast nozzle 8 is oriented at an inclination to the inlet side deflecting roller 2. The blast jet impinges on the web in the looping region of the roller 2 or even upstream of the looping region. Because of the Coanda effect, the air stream hugs the paper web 1 and escorts the latter at least to the blade 7. Because of the looping, the air stream spreads in a direction perpendicular to the paper web and uniformly. The blade 7 is fixed on an eccentrically journaled bar 9 which is tangential to the paper web passing by without significant deflection by it. Thus fluttering of the paper web under the effect of the air stream is avoided. After separating the flap 6, the blade is brought into a standby position by pivoting of the bar 9 in the sense of the arrow 10 so that the bar 9 is no longer in contact with the paper web. In this position it remains until the next flap approaches it.

Figure 3:
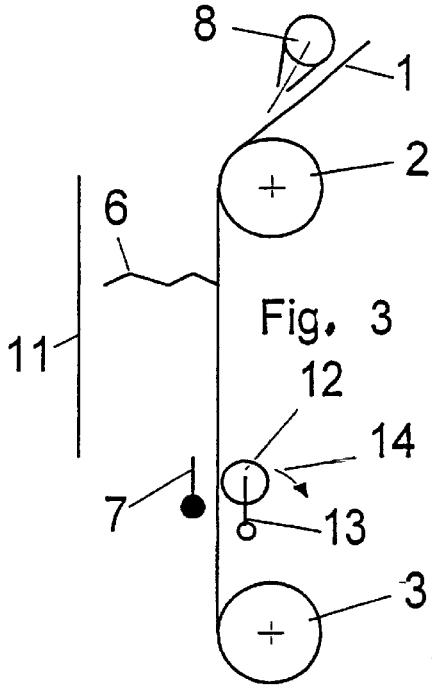
FIG. 3 is a diagram of a third embodiment of a flap-shortening apparatus according to the invention.

The embodiment of FIG. 3 differs from that of FIG. 2 in that a guide plate 11 is disposed approximately parallel to the traveling paper web along straight path segment 4 so that between the paper web 1 and the guide plate 11 a passage is formed. As a result, the air stream which effects the erection of the flap 6 is guided and held together. A further difference as to FIG. 2 is that a bar or roller 12 is provided as the support element for the paper web 1 and is located on the back side of the paper web 1. It is fixed to a pivot arm 13 which permits swinging in the sense of the arrow 14 from the active position illustrated in FIG. 3 into a standby position.

Figure 4:
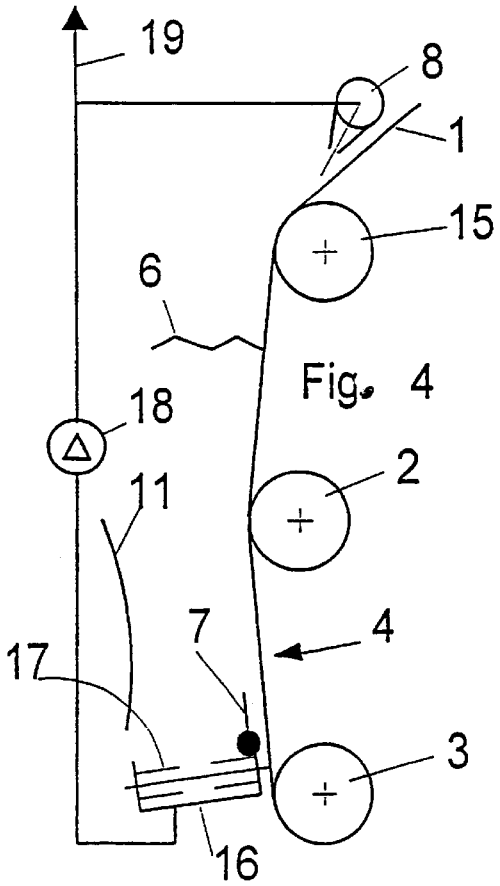
FIG. 4 is a diagram of a fourth embodiment of a flap-shortening apparatus according to the invention.

According to FIG. 4, the inlet side deflecting roller 2 is preceded in the web travel by an additional deflecting roller 15. The blast nozzle 8 is disposed above the deflecting roller 15 so that the blowing jet impinges on the paper web 1 already in the looping region of the deflecting roller 15 and depending upon the position of the blowing nozzle 18 even upstream of the contact line thereof. The air stream is deflected by the Coanda effect both at the deflecting roller 15 and also on the deflecting roller 2. In the region of the straight segment 4, it is guided by the guide plate 11. Adjacent the blade 7, a suction box 16 is arranged. It is equipped with an endless perforated belt 17 guided over rollers and which travels in a direction perpendicular to the plane of the drawing.

A blower 18 is connected at its suction side with the suction chamber 16 and at its pressure side with the blast nozzle 8. From the line running to the blast nozzle 8, a blowout line is branched. With a control element not visible in the drawing, the volume ratio between the air returned to the blowing nozzle 8 and the air blown out is influenced. The embodiment according to FIG. 4 is the advantage that the air is guided substantially in circulation. In this manner a strain upon service personnel by air impact can be avoided. An important advantage is also that the cutoff flaps are automatically captured by the circulating perforated belt 17 and can be delivered thereafter to a collecting vessel.

What is claimed is:

1. A method of shortening a flap lying on one side of a paper web formed by joining a length of web running off one roll to a length of web at a start of another roll, comprising the steps of:

(a) passing said paper web in a web travel direction along a straight path segment defined between two rollers engaging said paper web on a side thereof opposite said one side and extending from a start of said straight path segment to an end of said straight path segment;

(b) directing onto said web along said one side and in said travel direction an air stream which spreads over said web over at least a part of said straight path segment and inducing erection of said flap from said web; and (c) severing said flap from said web while it is erected and at a location upstream of said end of said straight path segment.

2. The method defined in claim 1 wherein said paper web is deflected around an upstream one of said rollers at said start of said straight path segment and said air stream is directed onto said paper web at a location upstream of contact between said paper web and said upstream one of said rollers.

3. The method defined in claim 1 wherein said paper web is deflected around an upstream one of said rollers at said start of said straight path segment and said air stream is directed onto said paper web at a location downstream of contact between said paper web and said upstream one of said rollers.

4. An apparatus for shortening a flap lying on one side of a paper web formed by joining a length of web running off one roll to a length of web at a start of another roll, comprising:

an upstream roller and a downstream roller defining a straight path section over which said paper web travels in a web travel direction and engaging said paper web on a side thereof opposite said one side, said straight path segment extending from a start of said straight path segment to an end of said straight path segment;

a blowing nozzle located upstream of a location at which said paper web runs onto said upstream roller and directing onto said web along said one side and in said travel direction an air stream which spreads over said web over at least a part of said straight path segment and induces erection of said flap from said web; and a cutting tool positioned close to said web on said one side thereof and downstream from said blowing nozzle with a cutting edge oriented opposite said web travel direction for severing said flap from said web while it is erected.

5. The apparatus defined in claim 4, further comprising a baffle plate disposed parallel to said paper web along said straight path segment.

6. The apparatus defined in claim 4, further comprising a suction box with a collecting sieve disposed adjacent said cutting tool.

7. The apparatus defined in claim 6 wherein said collecting sieve is a traveling sieve.

8. The apparatus defined in claim 6, further comprising a blower having a suction side connected to said suction box and a pressure side connected with said blowing nozzle.

9. The apparatus defined in claim 6, further comprising a support on said opposite side of said paper web in a region of said cutting tool and swingable selectively into a standby position spaced from said paper web and into an active position engaging said paper web.

10. An apparatus for shortening a flap lying on one side of a paper web formed by joining a length of web running off one roll to a length of web at a start of another roll, comprising:

an upstream roller and a downstream roller defining a straight path section over which said paper web travels in a web travel direction and engaging said paper web on a side thereof opposite said one side, said straight path segment extending from a start of said straight path segment to an end of said straight path segment;

a blowing nozzle located downstream of a location at which said paper web runs onto said upstream roller and directing onto said web along said one side and in said travel direction an air stream which spreads over said web over at least a part of said straight path segment and induces erection of said flap from said web; and a cutting tool positioned close to said web on said one side thereof and downstream from said blowing nozzle with a cutting edge oriented opposite said web travel direction for severing said flap from said web while it is erected.

11. The apparatus defined in claim 10, further comprising a baffle plate disposed parallel to said paper web along said straight path segment.

12. The apparatus defined in claim 10, further comprising a suction box with a collecting sieve disposed adjacent said cutting tool.

13. The apparatus defined in claim 12 wherein said collecting sieve is a traveling sieve.

14. The apparatus defined in claim 12, further comprising a blower having a suction side connected to said suction box and a pressure side connected with said blowing nozzle.

15. The apparatus defined in claim 10, further comprising a support on said opposite side of said paper web in a region of said cutting tool and swingable selectively into a standby position spaced from said paper web and into an active position engaging said paper web.

* * * * *